US006892737B2

(12) United States Patent
Benson

(10) Patent No.: US 6,892,737 B2
(45) **Date of Patent: *May 17, 2005**

(54) METHOD OF APPLYING A COSMETIC PRODUCT

(75) Inventor: Harvey Stanley Benson, Rockport, TX (US)

(73) Assignee: Lotion Puff, Inc., San Antonio, TX (US)

( * ) Notice: Subject to any disclaimer, the term of this patent is extended or adjusted under 35 U.S.C. 154(b) by 37 days.

This patent is subject to a terminal disclaimer.

(21) Appl. No.: 10/642,956

(22) Filed: Aug. 18, 2003

(65) Prior Publication Data

US 2004/0038809 A1 Feb. 26, 2004

Related U.S. Application Data

(62) Division of application No. 09/951,151, filed on Sep. 12, 2001, now Pat. No. 6,654,981
(60) Provisional application No. 60/233,723, filed on Sep. 19, 2000.

(51) Int. Cl.[7] ..... A45D 24/00

(52) U.S. Cl. ..... 132/200
(58) Field of Search ..... 132/200, 318, 132/317, 320; 15/244.1

(56) References Cited

U.S. PATENT DOCUMENTS 6,732,743 B1 * 5/2004 Bouix et al. ..... 132/200

* cited by examiner

*Primary Examiner*—John J. Wilson
*Assistant Examiner*—Robyn Doan
(74) *Attorney, Agent, or Firm*—Jackson Walker L.L.P.; Richard R. Ruble

(57) ABSTRACT

The present invention provides a method of applying a cosmetic product having an applicator body with a first longitudinal axis and defining external and internal walls. The internal walls of the present invention define at least one internal member having a second longitudinal axis and capable of movement between a retracted first position and a second projected position. The internal member of the present invention provides the consumer with one application surface adapted to apply relatively small amounts of one or more cosmetic products.

11 Claims, 8 Drawing Sheets

METHOD OF APPLYING A COSMETIC PRODUCT

This patent application is a divisional of, and claims priority from a utility patent application entitled "Cosmetic Applicator" having a Ser. No. of 09/951,151 and a filing date of Sep. 12, 2001 now U.S. Pat. No. 6,654,981, which claims the benefit of provisional application No. 60/233,723, filed Sep. 19, 2000.

FIELD OF THE INVENTION

The present invention relates generally to a method for applying a cosmetic product and, more particularly, to a method of using a cosmetic applicator having a movable internal member capable of providing an additional application surface for use in applying relatively small amounts of one or more cosmetic products.

BACKGROUND OF THE INVENTION

The application of cosmetic products can be difficult without the assistance of another person or a mechanical apparatus. Apparatus, such as that shown in FIG. 1, are typically used to assist the consumer in applying cosmetic products such as moisturizing lotions, suntan lotions, skin conditioners, topical medicines, cortizone creams, calamine lotion, shampoo, liquid soap, hair conditions, and the like. Such known apparatus provide a pad, ordinarily composed of soft plastic or rubber foam, for applying such products to the skin of the consumer. Typically, the pad is attached to a handle for grasping by the user.

Known cosmetic applicators are not adaptable to the individual needs of the consumer. Consumers wishing to apply various cosmetic products in varying amounts must typically purchase more than one cosmetic applicator. For example, consumers wishing to apply an expensive medicine to a relatively small area of skin will require a smaller pad with a smaller application surface. Alternatively, consumers wishing to apply an inexpensive suntan lotion to a relatively large area of skin will require a larger pad with a larger application surface.

Various devices have attempted to provide an easy-to-use applicator adaptable to the individual needs of the consumer. U.S. Pat. No. 1,748,406, issued to George W. Blair on Apr. 26, 1929, and entitled "Sponge" discloses a soap-retaining rubber sponge formed with a center cavity for retaining a cake of soap such that it may be completely enclosed within the body of the sponge when not in use. The invention described by the '406 patent provides a semi-circular or crescent incision within the sponge to facilitate access to the cavity.

U.S. Pat. No. 5,187,830, issued to Michael A. Giallourakis on Feb. 23, 1993, and entitled "Washing, Drying and Scrubbing Pad" discloses a nylon mesh-covered sponge having a braided pull at one end of the mesh covering and a pocketed jacket made of cleaning sheet material to receive and hold the net-covered sponge. The invention described by the '830 patent allows the net-covered sponge to be partially or fully withdrawn within the jacket pocket of the sponge.

U.S. Pat. No. 5,361,445, issued to Nicholas M. Giallourakis on Nov. 8, 1994, and entitled "Scrubber Washer Apparatus" discloses a chamois sponge for use in conjunction with a pocketed jacket. The invention described by the '445 patent provides a scrubber sheet, typically composed of a nylon mesh, for use in scrubbing especially soiled areas.

U.S. Pat. No. 5,351,356, issued to Charles E. Townsend, Jr., on Oct. 4, 1994, and entitled "Combination Sponge and Handle" discloses a sponge body formed with two perpendicular transverse notches being attached to an elongate handle. The invention described in the '356 patent provides a flared scraper blade to the outer end of the elongate handle for use in conjunction with the sponge body.

U.S. Pat. No. 5,904,151, issued to Jean-Louis H. Gueret on May 18, 1999, and entitled "Applicator for Friable Product and Application Unit Comprising Such an Applicator" discloses an applicator having a resiliently deformable element having at least one surface capable of applying a product. The invention described by the '151 patent has at least one hole opening out on the application surface such that at least one recess wherein the product is fixedly disposed is delimited.

U.S. Pat. No. 4,866,806, issued to Peter H. Bedford on Sep. 19, 1989, entitled "Surgical Scrub Sponge" discloses a multi-layered foam scrub brush for cleanup prior to a surgical procedure. The invention described by the '806 patent is shaped to fit the human hand and has a toothed profile on its edges such that a rough surface is presented for an augmented scrubbing capability.

There remains a need for a method of applying a cosmetic product capable of providing multiple application surfaces to conform to the needs of each individual consumer.

SUMMARY OF THE INVENTION

Accordingly, the present invention provides a cosmetic applicator for applying a cosmetic product capable of adapting to the individual needs of the consumer. To accomplish this, the present invention provides an applicator body defining external and internal walls.

The internal walls of the present invention define at least one internal member capable of movement between a first retracted position and a second projected position. In its retracted position, the internal member is concealed inside the body of the cosmetic applicator such that the user may apply relatively large amounts of one or more cosmetic products. In its projected position, the internal member extends outwardly from the applicator body and provides a smaller applicator surface through which the consumer may apply relatively small amounts of one or more cosmetic products.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
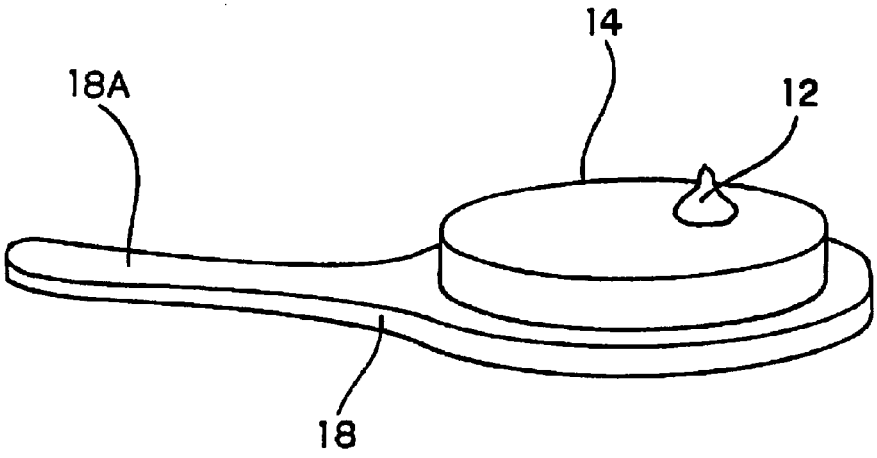
Fig. 1 Prior Art
FIG. 1 is a perspective view of a known cosmetic applicator.

Referring to the Figures, the present invention is herein described as a method of using a cosmetic applicator (10) for applying a cosmetic product (12) to the skin of the consumer.

The cosmetic applicator (10) of the present invention has an applicator body (14) having a first longitudinal axis (14L). The applicator body (14) is equipped with external walls (14E) which define first and second surfaces (20 and 22, respectively) upon which one or more cosmetic products (12) may be placed for application to the skin of the consumer. The applicator body (14) may be composed of any material suitable for contacting the skin of the consumer. In one embodiment, the applicator body (14) is composed of rubber foam or soft plastic.

Unfortunately, the first and second surfaces (20 and 22, respectively) of the cosmetic applicator (10) may be too large for efficient application of cosmetic products (12). Typically, a consumer may require an application surface smaller than that provided by the applicator body (14). Cosmetic products, such as medicine, are often expensive and should be applied sparingly. Additionally, some medicines must be applied only to infected skin in order to avoid potentially harmful side effects.

Figure 2:
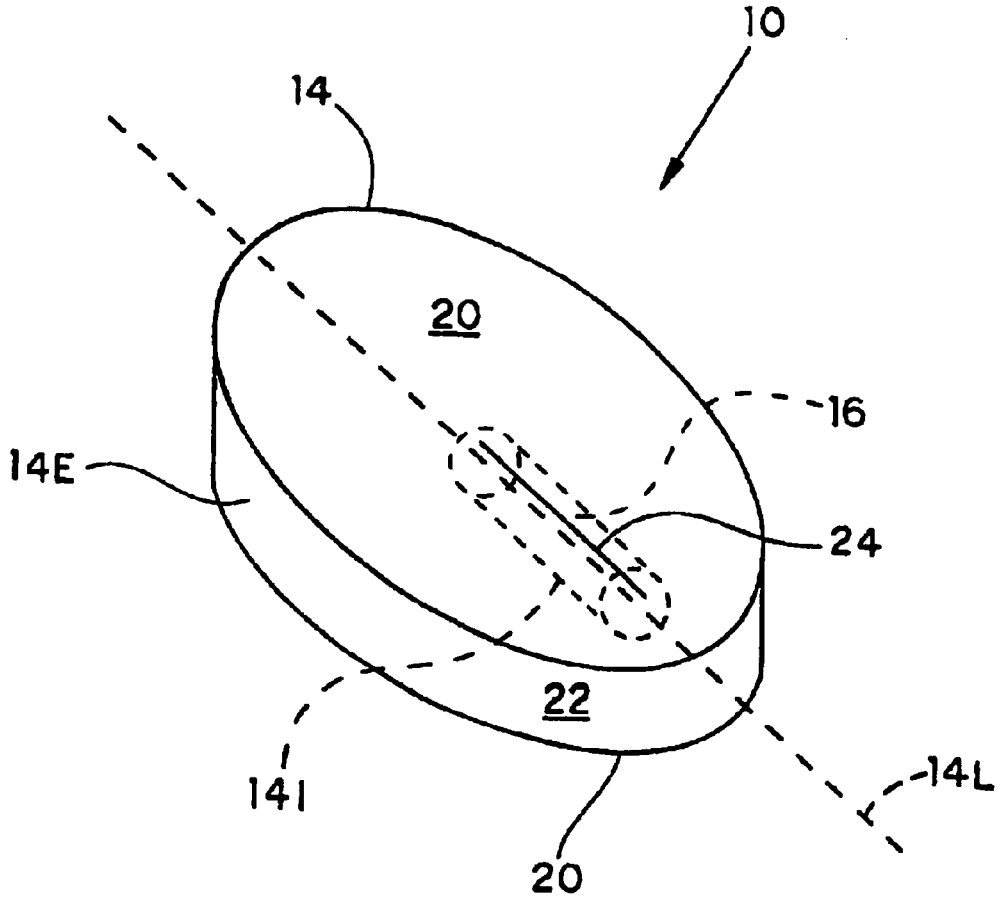
FIG. 2 is a perspective, cross sectional view of one embodiment of the present invention illustrating the internal member in a retracted position.

Referring to FIG. 2, the cosmetic applicator (10) of the present invention provides an internal member (16) having an application surface (16A) capable of applying relatively small amounts of one or more cosmetic products (12). Specifically, the body (14) of the cosmetic applicator (10) of the present invention is equipped with internal walls (14I) defining an internal member (16) having a longitudinal axis (16L). The internal member (16) is capable of movement between a retracted position located inside the body (14) of the cosmetic applicator (10) and a projected position where at least a portion of the internal member (16) is located outside the applicator body (14). In one embodiment, the cosmetic applicator (10) of the present invention is equipped with a mounting member (18) having a handle portion (18A) sized for grasping by the consumer.

Movement of the internal member (16) is facilitated by an incision (24) made to the body (14) of the cosmetic applicator (10). In one embodiment, the incision (24) is made to the first surface (20) of the body (14) and proceeds inside the body to a preselected depth (24D). In one embodiment, the internal member (16) projects through and above the first surface (20) when in a projected position and is located below the first surface (20) when in a retracted position. In another embodiment, the incision (24) is cut linearly with respect to the longitudinal axis (14L) of the applicator body (14).

The incision (24) of the present invention creates retaining walls (24R) capable of allowing the internal member (16) to move between a retracted position and a projected position. In one embodiment, the width of the incision (24) is designed to allow movement of the internal member (16) while also allowing the internal member to be secured in one or more positions. Specifically, the incision (24) must be wide enough to allow the internal member (16) to move in and out of the body (14) yet narrow enough to releasably secure the internal member. For example, if a large amount of a cosmetic product (12) is to be applied, the internal member (16) should be secured in a retracted position such that the first or second surfaces (20 and 22, respectively) of the applicator body (14) may be used to apply the cosmetic product. Alternatively, if a small amount of a cosmetic product (12) is to be applied, the internal member (16) may be secured in a projected position such that its relatively small application surface (16A) may be utilized.

Figure 3:
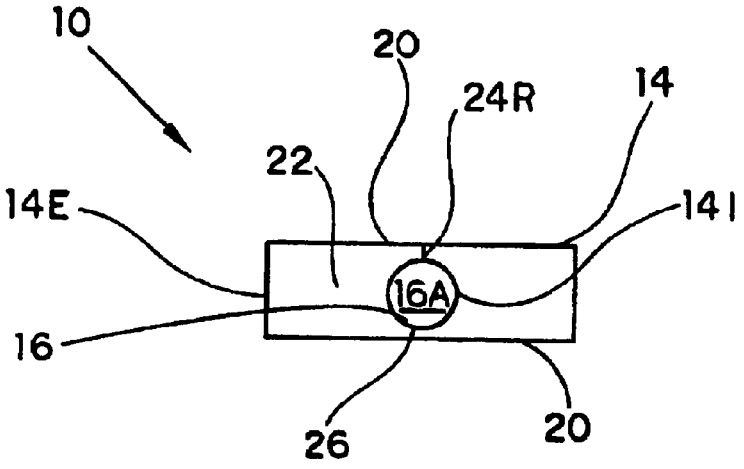
FIG. 3 is a side elevation view of one embodiment of the present invention.
Figure 4:
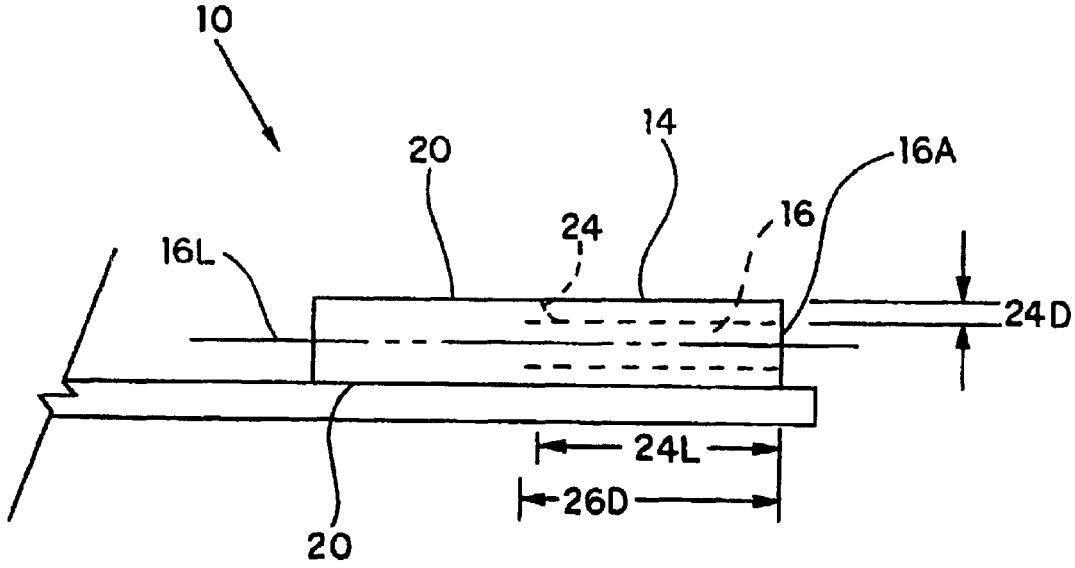
FIG. 4 is a side, cross sectional view of one embodiment of the present invention.
Figure 5:
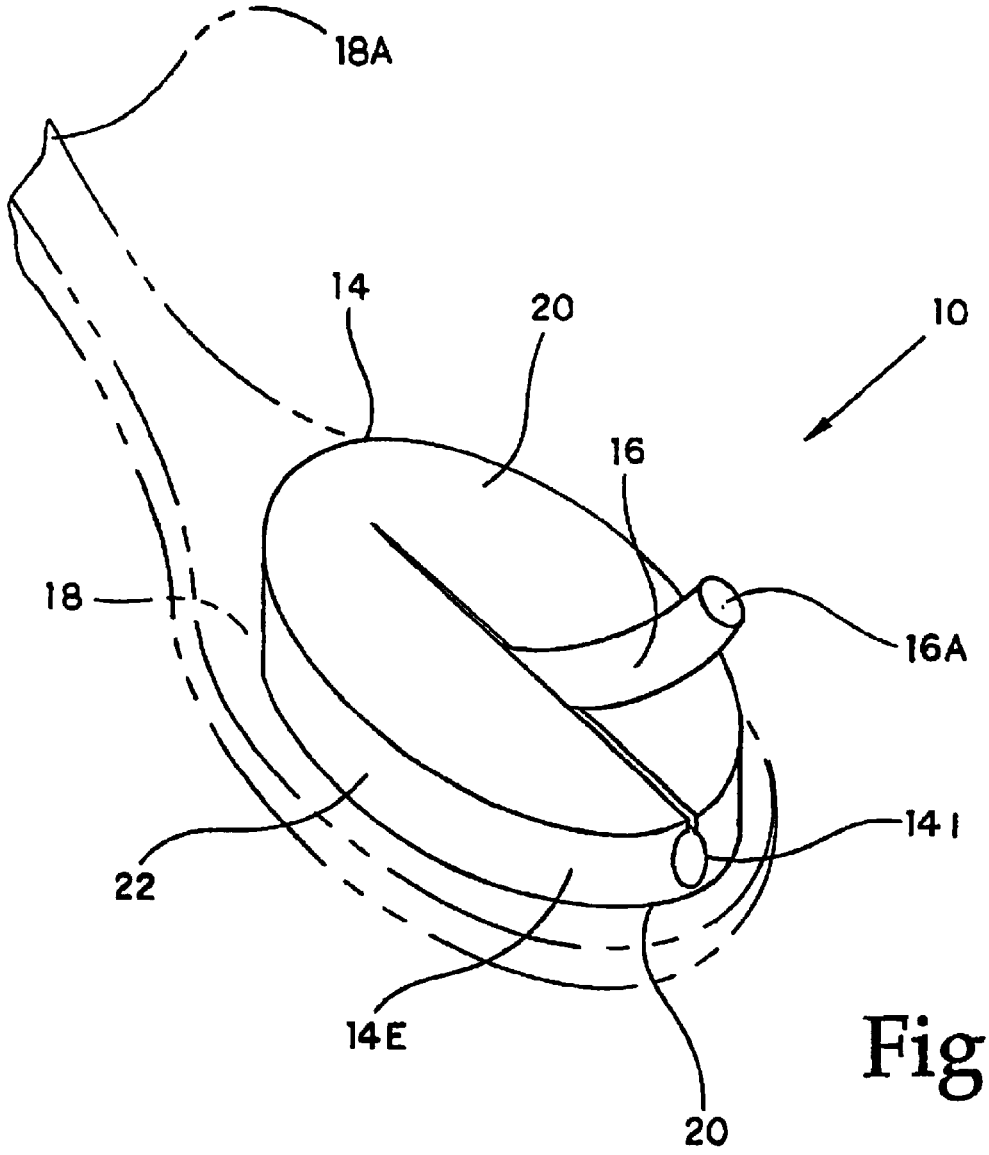
FIG. 5 is a perspective view of one embodiment of the present invention illustrating the internal member in a projected position.

Referring to FIGS. 3–5, in one embodiment, the internal walls (14I) of the present invention are formed by a second incision (26). Specifically, a second incision (26) may be cut a preselected depth (26D) into one or more external walls (14E) of the applicator body (14) to define the internal member (16) of the present invention. In one embodiment, the second incision (26) is cut into the second surface (22) of the applicator body (14) so that the consumer may conveniently access the internal member (16) such that it may be moved between a retracted and a projected position. In one embodiment, the internal member is positioned within the cosmetic applicator (10) such that the longitudinal axis (14L) of the applicator body (14) and the longitudinal axis (16L) of the internal member (16) are substantially aligned when the internal member is in a retracted position.

Limiting the size of the incisions (24 and 26, respectively) helps the cosmetic applicator (10) to retain its original shape. For example, in one embodiment, the length (24L) of the incision (24) is dimensioned to be equal to or less than the depth (26D) of the second incision (26). This feature of the present invention allows the consumer to more efficiently use the first and second surfaces (20 and 22, respectively) of the cosmetic applicator (10) when the internal member in a retracted position.

The present invention may be described as a method of using a cosmetic applicator (10) for applying a cosmetic product (12) to the skin of the consumer. First, the consumer grasps the internal member (16) located below the first surface in a retracted position and moves it to a projected position. To accomplish this, the consumer moves the internal member (16) through the retaining walls (24R) created by the first incision (24) such that at least a portion of the internal member (16) is located above the first surface (20). Second, the consumer releases the internal member (16) such that it may be held in place above the first surface (20) in a projected position by the retaining walls (24R).

Once the internal member (16) is in a projected position, the consumer then places a predetermined amount of the desired cosmetic product (12) upon the application surface (16A) of the internal member (16). A relatively small amount of cosmetic product (12) may then be applied to his or her skin using the application surface (16A) of the internal member (16). Once the cosmetic product (12) has been applied, the consumer grasps and moves the internal member (16) downwardly through the retaining walls (24R) such that the internal member is positioned below the first surface (20) of the applicator body (14).

Figure 6:
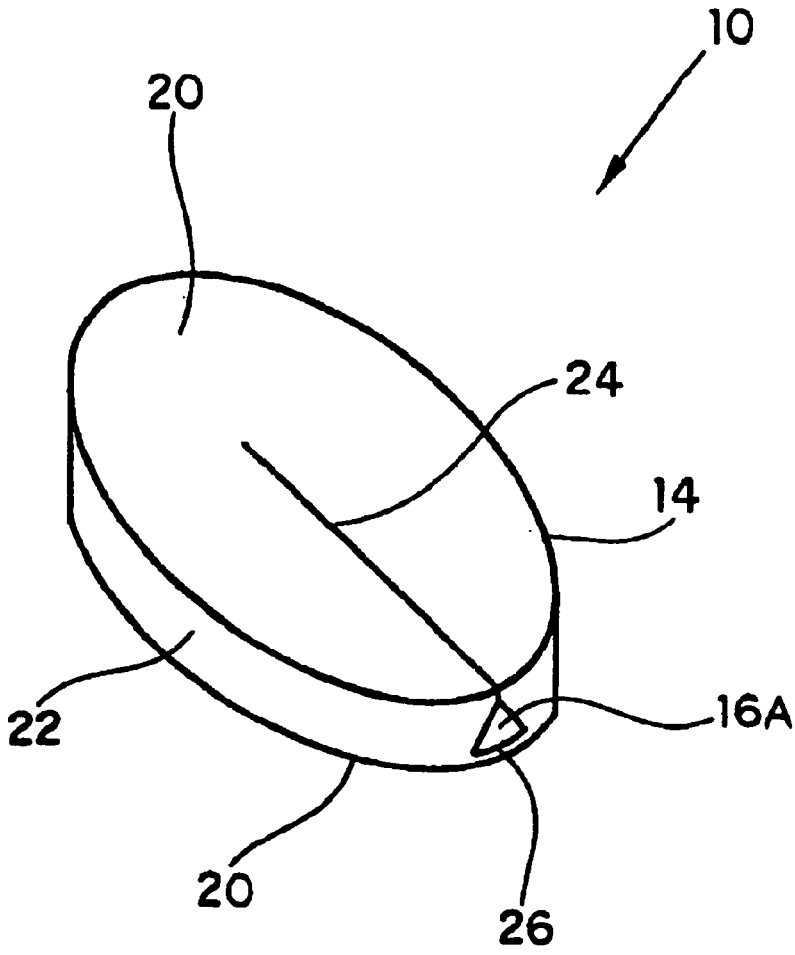
FIG. 6 is a perspective view of one embodiment of the present invention illustrating an internal member having a generally triangular configuration.
Figure 7:
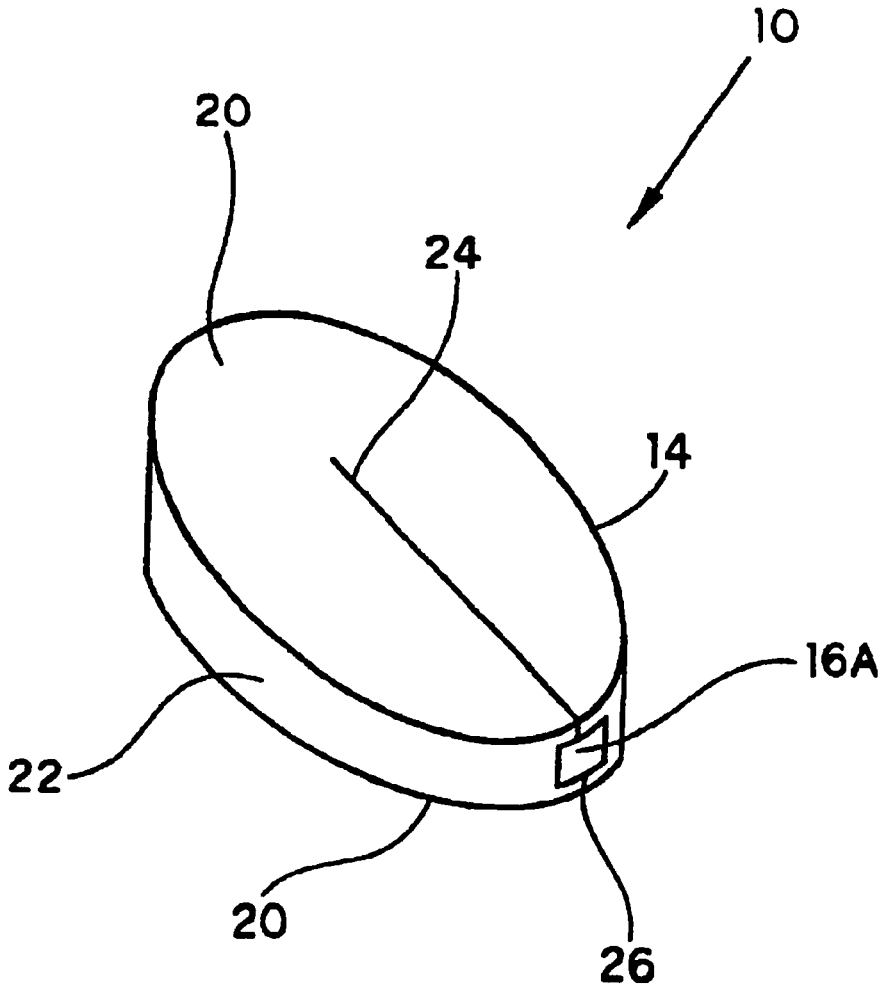
FIG. 7 is a perspective view of one embodiment of the present invention illustrating an internal member having a generally rectangular configuration.
Figure 8:
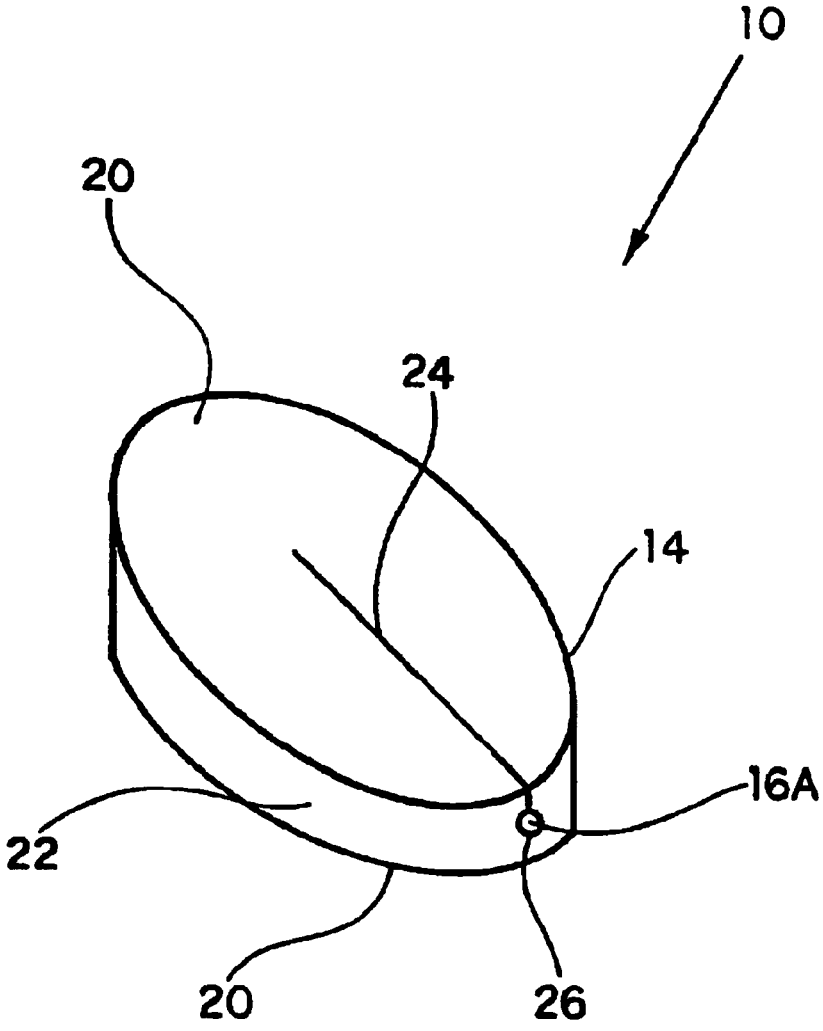
FIG. 8 is a perspective view of one embodiment of the present invention illustrating an internal member having a teardrop configuration.

Referring to FIGS. 6–8, the present invention is extremely versatile in its construction and design. For example, the cosmetic applicator (10) of the present invention may be equipped with a plurality of internal members (16). In one embodiment, each internal member is capable of movement between a retracted position and a projected position by interacting with one or more incisions (24) cut into the applicator body (14). Additionally, the shape of the internal member (16) may be altered to provide the consumer with the most efficient application surface. In one embodiment, the internal member (16) of the present invention has a substantially cylindrical configuration. The applicator body (14) of the present invention may have varying shapes and sizes. For example, the body (14) may comprise a circular, spherical, cubical, cylindrical, triangular, elliptical or any other shape suitable to enable the purposes of the present invention.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

I claim:

1. A method of using a cosmetic applicator for applying a cosmetic product comprising the steps of:

providing a three-dimensional applicator body, said body defining external walls including a first surface, said applicator body comprising at least one internal member having a longitudinal axis and further being capable of movement between a first retracted position beneath said first surface and a second projected position where said internal member extends at least partly above said first surface of said body, wherein said internal member does not form a portion of said first surface while in said first retracted position;

moving said internal member from said first retracted position to said second projected position;

placing a predetermined amount of said cosmetic product upon said internal member; and applying said cosmetic product to the skin of said user.

2. The method of claim 1, wherein said cosmetic applicator further comprises a mounting member attached to said applicator body, said mounting member shaped to define a grasping portion.

3. The method of claim 1, wherein said internal member further comprises an application surface for receiving said predetermined amount of said cosmetic product.

4. The method of claim 1, wherein said applicator body comprises rubber, foam, sponge, or soft plastic.

5. The method of claim 1, wherein said first surface further comprises a slit cut to a predetermined depth into said body.

6. The method of claim 1, wherein said external walls include a second surface non-parallel to said first surface and wherein said internal member has a removed end capable of movement between said first position and said second position, said second surface having an aperture being cut to a preselected to a preselected depth into said body and defining a removed end of said internal member.

7. The method of claim 6, wherein said first incision defines retaining walls through which said internal member may project and be releaseably secured by when and said second projected position.

8. A method of preparing a cosmetic applicator for applying a cosmetic product comprising the steps of:

providing a three-dimensional applicator body, said body defining external walls including a first surface, said applicator body comprising at least one internal member having a longitudinal axis;

executing a first incision upon said first surface to a preselected depth into said body such that said internal member is capable of movement between a first retracted position wherein said internal member does not form a portion of said first surface and a second projected position where said internal member extends through walls created by said first incision such that at least a portion of said internal member extends above said first surface of said body while in said second projected position.

9. The method of claim 8, wherein said external walls include a second surface non-parallel to said first surface and wherein said internal member has a removed end capable of movement between said first position and said second position.

10. The method of claim 9, further comprising the additional step of executing a second incision upon said second surface to a preselected depth into said body such that a second set of walls created by said second incision defining said removed end of said internal member.

11. The method of claim 10, wherein said first incision is cut to a predetermined length into said body, said predetermined length of said first incision being substantially equal to or less than said preselected depth of said second incision.

* * * * *